US010906799B2

(12) United States Patent
Wu

(10) Patent No.: US 10,906,799 B2
(45) Date of Patent: Feb. 2, 2021

(54) SAFETY STIRRUP AND STRAP SYSTEM

(71) Applicant: Monica Pi-Jung Wu, Lexington, MA (US)

(72) Inventor: Monica Pi-Jung Wu, Lexington, MA (US)

( * ) Notice: Subject to any disclaimer, the term of this patent is extended or adjusted under 35 U.S.C. 154(b) by 224 days.

(21) Appl. No.: 16/117,440

(22) Filed: Aug. 30, 2018

(65) Prior Publication Data

US 2018/0370789 A1 Dec. 27, 2018

Related U.S. Application Data

(63) Continuation of application No. PCT/US2017/026487, filed on Apr. 7, 2017.

(60) Provisional application No. 62/319,515, filed on Apr. 7, 2016.

(51) Int. Cl.
*B68C 3/00* (2006.01)
*B68C 1/16* (2006.01)

(52) U.S. Cl.
CPC ..... *B68C 3/00* (2013.01); *B68C 1/16* (2013.01); *B68C 2003/0041* (2013.01); *B68C 2003/0075* (2013.01)

(58) Field of Classification Search
CPC ..... B68C 3/00; B68C 2003/0041; B68C 2003/0075; B68C 2003/0083; B68C 2003/0008; B68C 3/0016; B68C 2003/0025; B68C 2003/0033; B68C 2003/005; B68C 2003/0058; B68C 2003/0066; B68C 2003/0091; B68C 3/02; B68C 3/025; B68C 1/16; B68C 1/18; B68C 1/14; B68C 1/147; B68C 2001/142; B68C 2001/145; A44B 11/20; A44B 11/008; A44B 11/2557; A41F 9/02; A41F 9/025; A41F 9/00; A41F 9/002; A41F 9/007; Y10T 24/4002; Y10T 24/4037; Y10T 24/4047; Y10T 24/342; Y10T 24/45063; Y10T 24/45079; Y10T 24/45084

See application file for complete search history.

(56) References Cited

U.S. PATENT DOCUMENTS

| | | | | |
|---|---|---|---|---|
| 313,609 A | | 3/1885 | Nolen et al. | |
| 847,896 A | | 3/1907 | Breitenstein | |
| 1,335,826 A | | 4/1920 | Faithfull | |
| 4,233,712 A | * | 11/1980 | Horst | A44B 11/226 24/166 |

(Continued)

FOREIGN PATENT DOCUMENTS

| | | | | |
|---|---|---|---|---|
| FR | 3027892 A1 | * | 12/2019 | B68C 1/16 |
| JP | 2010261117 A | | 11/2010 | |

OTHER PUBLICATIONS

Wu, M., TherapyShare: Reinbow Stirrup System. Aha, Inc., Jan. 11, 2017. [online] [retrieved 1-14 on Jun. 19, 2017]. Retrieved from the Internet: URL: <https://wwwJacebook.com/horsetherapyconnections/photos/pcb.1844222712502051.

*Primary Examiner* — Kathleen I Alker
(74) *Attorney, Agent, or Firm* — Elmore Patent Law Group, P.C.; Carolyn Elmore; Mahreen Hoda

(57) ABSTRACT

The present invention provides a safety stirrup and strap system for quick and easy stirrup adjustment for use with a saddle or similar type of riding equipment used during equine assisted therapies or in any recreational riding wherein quick and easy stirrup adjustment is desired.

6 Claims, 1 Drawing Sheet

(56) References Cited

U.S. PATENT DOCUMENTS

| | | | | |
|---|---|---|---|---|
| 5,802,608 | A * | 9/1998 | Earl | A41F 9/002 2/1 |
| 6,513,309 | B1 | 2/2003 | Morgante | |
| 7,073,313 | B1 * | 7/2006 | Mullenbach | B68C 3/00 54/47 |
| 2006/0168918 | A1 * | 8/2006 | Naslund | B68C 1/02 54/44.1 |
| 2007/0051076 | A1 * | 3/2007 | Dabbs | A44B 11/24 54/46.1 |
| 2010/0045022 | A1 | 2/2010 | Shigaraki et al. | |
| 2014/0082891 | A1 * | 3/2014 | Hetrick | A44B 11/04 24/115 H |

* cited by examiner

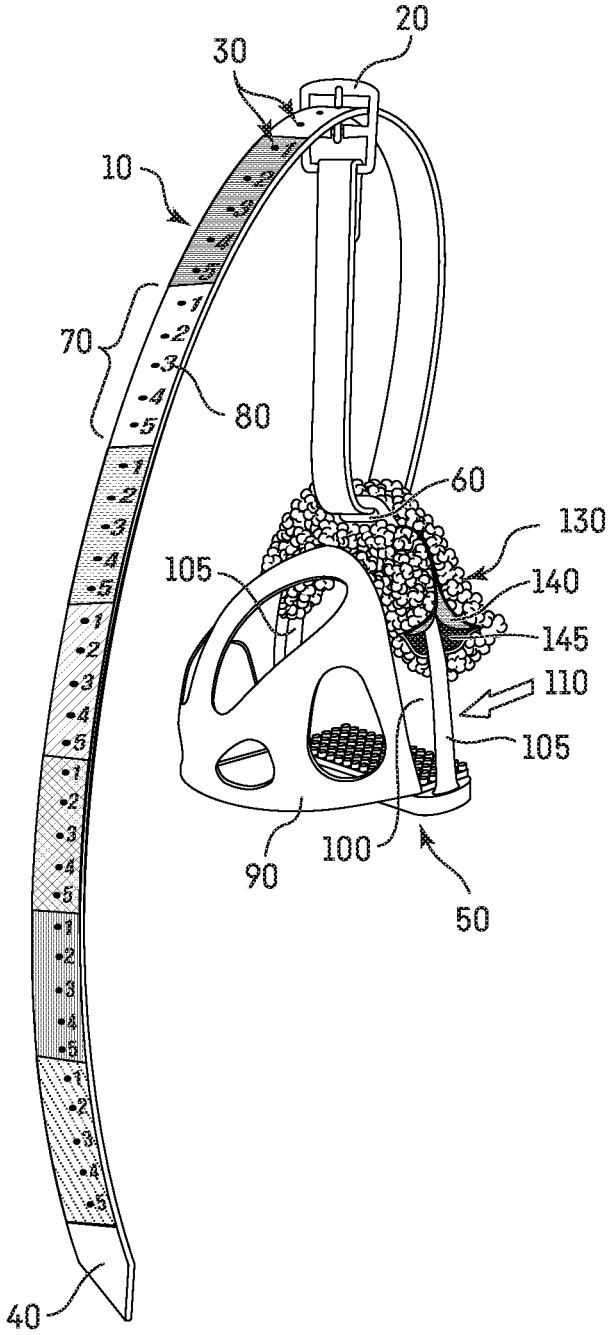
20
30
10
70
80
60
130
105
140
145
110
105
100
90
50
40

SAFETY STIRRUP AND STRAP SYSTEM

RELATED APPLICATION

This application is a continuation of International Application No. PCT/US17/26487, which designated the United States and was filed on Apr. 7, 2017, published in English, which claims the benefit of U.S. Provisional Application No. 62/319,515, filed on Apr. 7, 2016. The entire teachings of the above applications are incorporated herein by reference.

BACKGROUND OF THE INVENTION

Occupational therapists, physical therapists and/or speech and language pathologists use hippotherapy to treat patients. Hippotherapy uses equine movement to enhance the balance and muscle function of people with neurological disorders, for example, amongst other benefits. This technique originated in Germany and has been used in the United States since the 1950's. In the United States licensed physical and occupational therapists have designed hippotherapy treatments for thousands of neurologically impaired riders.

Physical therapists have documented the following medical benefits of hippotherapy: decreased spasticity, improved balance, improved coordination, improved gait, improved posture, and improved range of motion. Occupational therapists have reported that hippotherapy improves the organization of the sensory system, increases oral motor control, improves cognition, awareness, and processing, improves hand control, and increases the psycho-social interaction of the rider with the environment.

Problems associated with hippotherapy often arise due to the condition of the rider/patient. Neurologically-impaired riders often require three to four people at the horse arena to (a) determine the most therapeutic position for the rider receiving hippotherapy, (b) groom and saddle the horse, (c) assist in the transfer to and from the horse, and (d) lead or walk beside the horse. Physically or psychologically impaired riders sometimes have weak or no strength in their hands which prevents the riders from forming a good grip onto the horn of a horse's saddle. Furthermore, riders often have poor balance and coordination.

Because of the limitations of the patient, it often takes a significant period of time for the specialized hippotherapy equipment to be properly adjusted to the benefit of the rider/patient. This task alone takes away from the already limited time period in which a hippotherapy session may be conducted which is usually no more than 45 minutes, and more often less than 30 minutes, mostly due to the limitations of the rider/patient.

There is a need for specialized riding equipment that is quickly and easily adjustable to enable the patient/rider or the therapist and assistants to quickly and precisely adjust the equipment to suit the needs of one or more patients who may be using the equipment.

SUMMARY OF THE INVENTION

The present invention provides a safety stirrup and strap system for quick and easy stirrup adjustment for use with a saddle or similar type of riding equipment used during hippotherapy and other equine assisted therapies or in any recreational riding wherein quick and easy stirrup adjustment is desired.

BRIEF DESCRIPTION OF THE DRAWINGS

The FIGURE is a perspective view of the stirrup and strap system of the invention.

DETAILED DESCRIPTION OF THE INVENTION

The terms "a", "an" and "the" as used herein are defined to mean "one or more" and include the plural unless the context is inappropriate.

The term "comprising" as used herein which is synonymous with "including," "containing," or "characterized by," is inclusive or open-ended and does not exclude additional, unrecited elements of a composition or method steps. The term "consisting of" excludes any element, step, or ingredient that is not otherwise specified. The term "consisting essentially of" limits the scope of a composition or method to the specified materials or steps and those that do not materially affect the basic and novel characteristic(s) of the specified composition or method.

The term "therapist" as used herein includes occupational therapists, physical therapists and speech and language pathologists, who may in incorporate equine assisted therapies including hippotherapy as a treatment strategy.

The term "normal use" is used herein to denote the configuration of the stirrup when a rider is mounted on a horse to which a pair of stirrups is fitted with each foot of the rider in respective stirrups of the pair.

The stirrup and strap system of the invention comprises a stirrup strap having a buckle at one end for receiving the opposite end of the strap thereby creating a loop upon which a stirrup is attached, wherein the stirrup strap includes a plurality of buckle holes along the length of the stirrup strap through which the buckle may be fastened when the stirrup strap is looped for use in conjunction with a stirrup and the saddle. The buckle holes are divided into groups which are made apparent by demarcating each group of buckle holes as blocks using any type of visual system such as color, patterns, etc. such that each block appears visually different from the blocks on either side of the reference block. The buckle holes of each block also include indicia for each hole which may include numbering or lettering using any numbering or lettering system known. Preferably each block along the stirrup strap includes the same number of buckle holes, and the indicia used in each block of buckle holes is repeated for each block along the stirrup strap. For example, each block along the stirrup strap includes 5 buckle holes which are each numbered 1-5.

The stirrup and strap system of the invention optionally further comprises a safety stirrup suspended from the looped stirrup strap of the invention. A safety stirrup is designed to prevent inadvertent passage of a rider's foot completely through the stirrup. Many types of safety stirrups are known and approved by the Professional Association of Therapeutic Horsemanship (PATH). The safety stirrup optionally further comprises a removable protective cover around the upper portion of the stirrup to prevent the stirrup from banging into the foot or ankle of the patient/rider and causing injury to the patient/rider. The protective cover also functions to soften the effects felt by the horse as a result of the rider's foot inserted into the stirrup.

The stirrup and strap system of the invention follows the Professional Association of Therapeutic Horsemanship (PATH) International standards and guidelines for equine assisted activities (EAAT) and therapies. The stirrup and strap system of the invention allows for quick easy stirrup adjustment with safety features that follow the PATH International standards and guidelines for Equine Assisted Activities (EAAT) and Therapies. The stirrup system of the invention is not only limited to EAAT but can also be used in typical recreational riding.

The stirrup and strap system preferably comprises a unitary stirrup strap that comprises brightly color coded blocks with indicia (e.g., numbers 1-5) associated with the stirrup buckle holes to allow for quick stirrup adjustment. A rider, instructor or therapy team can quickly adjust the stirrups by knowing color and number at which to set the stirrups, for example one patient may require that the stirrups be set at block blue, hole number 2 for a first patient while the next patient may need the stirrups set at block red, hole number 4. The stirrup system of the invention also comprises optional stirrup leather clips for easy on and off on tack such as bareback saddle pads or other therapeutic saddles.

The stirrup and strap system optionally includes safety stirrups wherein the stirrup bars are optionally partially or totally covered with a removable soft material to protect the rider's ankles to add to comfort for both rider and horse. Examples of a removable soft material include fleece pads, foam padding etc. Preferably the safety stirrup is equipped with safety cages that ensure that the foot cannot get trapped and can safely be removed in case of an emergency. However, any type of approved safety stirrup such as the well-known "peacock" safety stirrup, S-shaped stirrups and Devonshire stirrups may be used in the same way.

Preferably the blocks of holes along the stirrup leathers are demarcated using bright colors such as colors of the rainbow (e.g., violet, indigo, blue, green, yellow orange and red). Colors of the rainbow are identifiable and bright for individuals with vision issues and other cognitive issues as is often the case with patients receiving hippotherapy. The bright colors also allow the patients, who often find it difficult to learn these basic colors due to their cognitive impairments to memorize the color block at which their stirrups must be adjusted which allows for independence building confidence. The color system also helps therapists and assistants quickly and efficiently set the stirrups to the proper length for the patient/rider.

Preferably the number of buckle holes in each block of buckle holes is between 1 and 5. The numbers 1-5 are readily identifiable by children and others with cognitive and/or intellectual disabilities. For example, if 10 buckle holes are included in each block instead of just 5 buckle holes, patients/riders may find ten indicia instead of five indicia to be too visually stimulating and harder for such an individual to track quickly. Preferably the number is arranged from the top of the stirrup leather (top meaning toward the saddle when stirrup and strap are attached to the saddle) to the bottom of the stirrup leather (meaning toward the ground when stirrup and strap are attached to the saddle). Such an arrangement of numbers in an orientation from top (#1) to bottom (#5) also assists patient's/riders development a cognitive understanding of top to bottom.

The stirrup straps of the invention may be created by modifying standard stirrup straps which may be purchased at any tack store. Stirrup straps come in several kinds of materials including synthetic materials. The most popular are leather. Stirrup straps come in lengths suitable for children and adults. Stirrup leathers come in a variety of lengths for children and adults. Any stirrup strap can be used to create the safety stirrup and strap system of the invention such that the system may be used with any sized rider.

Standard stirrup straps may be modified to include the appropriate number of buckle holes such that when visual indication of blocks are incorporated into the stirrup strap such as by painting colors or patterns, etching colors or patterns, electronically transferring colors or patterns using lasers and/or any other computer assisted marking techniques, or by any other means for transferring color, patterns or other visual indication that creates blocks of buckle holes, each buckle hole has its own separate indicia such as a number within each block.

The safety stirrup and strap system of the invention optionally also includes safety stirrups which may be purchased and modified in accordance with the invention. Preferred safety stirrups are those approved by PATH and also come in child and adult sizes. Preferably the upper part of the safety stirrup is covered with removable protective covering that is soft and thick. Such covering includes but is not limited to foam, fleece and leather. The covering is placed on the upper stirrup bars of the stirrup to protect exposed ankles from possibly getting rubbed against the metal stirrup bars and to provide enhanced comfort for the patient/rider as well as for the horse.

Preferably the safety stirrups include cages that are fastened to the stirrups as a safety feature so the feet can be quickly removed and will not get caught in emergency situations. Also, the cages allow volunteers to position and support the leg during adaptive/therapeutic riding lessons or hippotherapy sessions without grabbing onto clothing or possibly pinching the rider/client. This allows for comfort for both rider/client and volunteer. Cages come in child and adult sizes.

Turning now to the FIGURE, the stirrup strap system of the invention comprises a stirrup strap 10 formed of a flexible elongated length of material such as leather nylon, leather, or any other suitable material. The stirrup strap comprises a buckle 20 at one end. The stirrup strap 10 comprises multiple buckle holes 30 for adjusting the position of the stirrup 50.

To form the stirrup strap system of the invention, the opposite end 40 of the stirrup 50 is fed through an aperture 60 on the stirrup 50 for receiving the stirrup and the distal end 40 of the stirrup strap 10 is fed through the buckle 20 to the appropriate buckle hole 30.

It is noted that during normal use, the stirrup strap system of the invention may thereafter be attached to the saddle by well-known means such as looping through a ring or slot on the saddle (not shown). Clips (not shown) may also be attached to the buckle 20 for clipping the buckle 20 to the ring or slot on the saddle (not shown) instead of looping the stirrup strap 10 through the ring or slot of the saddle (not shown).

The buckle holes 30 of the stirrup strap 10 are divided into a plurality of blocks of buckle holes 70. Each block of buckle holes 70 is demarcated by a different visual means. For purposes of illustration, each block of buckle holes 70 is demarcated by a different type of shading and/or cross-hatching. However, it is preferred that each block is demarcated by a different color, preferably a bright color, such as violet, indigo, blue, green, yellow orange or red.

Each buckle hole 30 in each block of buckle holes 70 includes some visual indicia such as an arrangement of numbers 80 in an orientation from top (e.g., #1) to bottom (e.g., #5).

The stirrup 50 may be any type of safety stirrup. For the purposes of illustration, the stirrup 50 comprises a cage 90 adapted to receive the front portion of a rider's foot (not shown) (e.g., the toes or ball of the rider's foot). The cage

90 prevents the rider's foot from passing all the way through the archway 100 created by the bars 105 of stirrup 50. The arrow 110 shows the direction of entry of the rider's foot (not shown) into the stirrup 50.

The removable padding 130 is wrapped around all or a portion of the stirrup bars 105. The removable padding 130 may be made of any soft thick material such as foam or sheepskin. The removable padding 130 may be removably secured to the stirrup bars 105 of the stirrup 50 via any means known in the art including but not limited to hook and loop material (140, 145). Other removable materials include removable fabric adhesive and double-sided sticky tape.

While this invention has been particularly shown and described with references to preferred embodiments thereof, it will be understood by those skilled in the art that various changes in form and details may be made therein without departing from the scope of the invention encompassed by the appended claims. It should also be understood that the preferred embodiments described herein are not mutually exclusive and that features from the various preferred embodiments may be combined in whole or in part in accordance with the invention.

What is claimed is:

1. A safety stirrup and strap system comprising:

a stirrup strap formed of a flexible elongated material having a buckle at one end and an opposite end distal to the buckle wherein the buckle is capable of receiving the opposite end of the stirrup strap thereby providing a loop from which a safety stirrup may be suspended in a normal use position;

a safety stirrup comprising stirrup bars defining an arch wherein the safety stirrup is suspended from the stirrup strap wherein the safety stirrup comprises removable padding wrapped around all or a portion of the bars defining the arch of the safety stirrup;

wherein the stirrup strap comprises a plurality of separate and discrete blocks of buckle holes adjacent to each other along the stirrup strap, wherein each separate block contains the same number of buckle holes and wherein each buckle hole contained in each block is demarcated by a unique indicia selected from numbering or lettering of each buckle hole.

2. The safety stirrup and strap system of claim 1, wherein the blocks of buckle holes are identified by using a bright color.

3. The safety stirrup and strap system of claim 2, wherein each separate block contains 5 buckle holes.

4. The safety stirrup and strap system of claim 1, wherein the unique indicia are numbers.

5. The safety stirrup and strap system of claim 1, wherein the removable padding comprises fleece or foam.

6. The safety stirrup and strap system of claim 1, wherein the removable padding is secured to the bars of the stirrup by hook and loop material.

* * * * *